United States Patent [19]

Kawano et al.

[11] Patent Number: 4,561,760

[45] Date of Patent: Dec. 31, 1985

[54] CLEANING DEVICE FOR CLEANING COPY PAPER SEPARATION DEVICE IN ELECTROPHOTOGRAPHIC COPYING MACHINE

[75] Inventors: Tadaaki Kawano, Nara; Keizo Ito, Yamatokoriyama; Takashi Nishida, Ibaragi, all of Japan

[73] Assignee: Sharp Kabushiki Kaisha, Osaka, Japan

[21] Appl. No.: 645,261

[22] Filed: Aug. 29, 1984

[30] Foreign Application Priority Data

Sep. 6, 1983 [JP] Japan ..... 58-165583

[51] Int. Cl.[4] ..... G03G 15/00

[52] U.S. Cl. ..... 355/3 R; 355/3 SH

[58] Field of Search ..... 355/3 SH, 14 SH, 15, 355/3 R, 70; 271/DIG. 2, 174, 311

[56] References Cited

U.S. PATENT DOCUMENTS

| | | | |
|---|---|---|---|
| 3,992,000 | 11/1976 | Martin | 271/174 |
| 4,364,657 | 12/1982 | Landa | 355/3 SH |
| 4,387,981 | 6/1983 | Cormier | 355/3 SH |
| 4,417,800 | 11/1983 | Hirose et al. | 355/3 SH |
| 4,420,243 | 12/1983 | Baker et al. | 355/3 SH |
| 4,464,042 | 8/1984 | Omori et al. | 355/3 SH |
| 4,511,238 | 4/1985 | Hori | 355/3 SH |

*Primary Examiner*—A. C. Prescott

*Attorney, Agent, or Firm*—Birch, Stewart, Kolasch & Birch

[57] ABSTRACT

An electrophotographic copying machine including a cleaning device for cleaning at least a tip of a separation claw separating a copied paper from a photoreceptor. The separation claw is pivotally moved between a first position separating the copied paper and a second position of cleaning itself by the cleaning device. At least one solenoid is provided for pivotally moving the separation claw between the first position and the second position.

5 Claims, 6 Drawing Figures

CLEANING DEVICE FOR CLEANING COPY PAPER SEPARATION DEVICE IN ELECTROPHOTOGRAPHIC COPYING MACHINE

BACKGROUND OF THE INVENTION

The present invention relates to an electrophotographic copying machine and, more particularly, to a cleaning device for cleaning a separation device in an electrophotographic copying machine, in which the separation device is provided for separating a copied paper from a photoreceptor.

An electrophotographic copying machine produces an electrostatic latent image onto a photoreceptor corresponding to a pattern image on a document such as a manuscript or book to be copied. Toner particles are electrostatically adhered to the latent image, so that the latent image becomes visible as a toner image. The toner image on the photoreceptor is transferred onto a copy paper by a transference charger.

Conventionally, to separate the copied paper from the photoreceptor, either mechanical separation means or electrostatical separation means are provided. As the mechanical separation means, a separation claw is provided as being faced to the photoreceptor for separating the copied paper when the separation claw becomes somewhat close to the surface of the photoreceptor.

Some of the toner particles remain on the photoreceptor even after the major parts of the toner particles disposed on the photoreceptor are transferred onto the copy paper during the image transfer. Therefore, the separation claw being close to the surface of the photoreceptor may scrape the remaining toner particles from the photoreceptor, so that the tip of the separation claw may become dirty with the toner particles. The thus scraped toner particles may drop onto the copied paper, thereby decreasing copied paper cleanliness.

SUMMARY OF THE INVENTION

Accordingly, it is an object of the present invention to provide a novel cleaning device for cleaning a separation device separating a copied paper from a photoreceptor in an electrophotographic copying machine, so that the copied paper remains clean.

It is another object of the present invention to provide a novel cleaning device for cleaning a separation claw separating a copied paper from a photoreceptor.

Briefly described, in accordance with the present invention, an electrophotographic copying machine comprises a cleaning device for cleaning at least a tip of a separation claw separating a copied paper from a photoreceptor. The separation claw is pivotally moved between a first position separating the copied paper and a second position for cleaning itself by the cleaning device. Solenoid means is provided for pivotally moving the separation claw.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
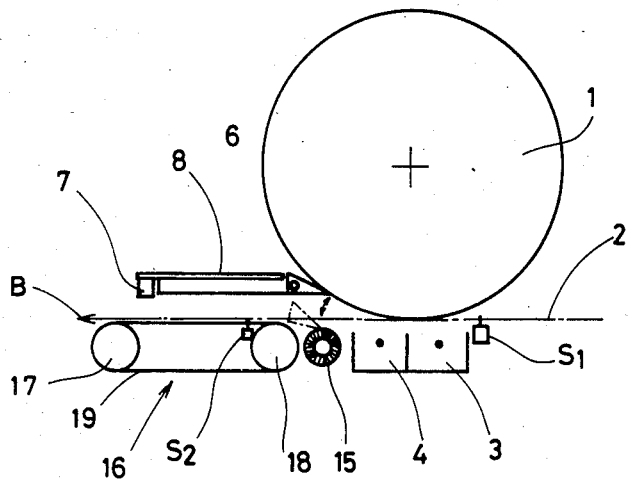
FIG. 1 is a side view of a cleaning device for cleaning a separation device such as a separation claw in an electrophotographic copying machine according to the present invention.
Figure 2:
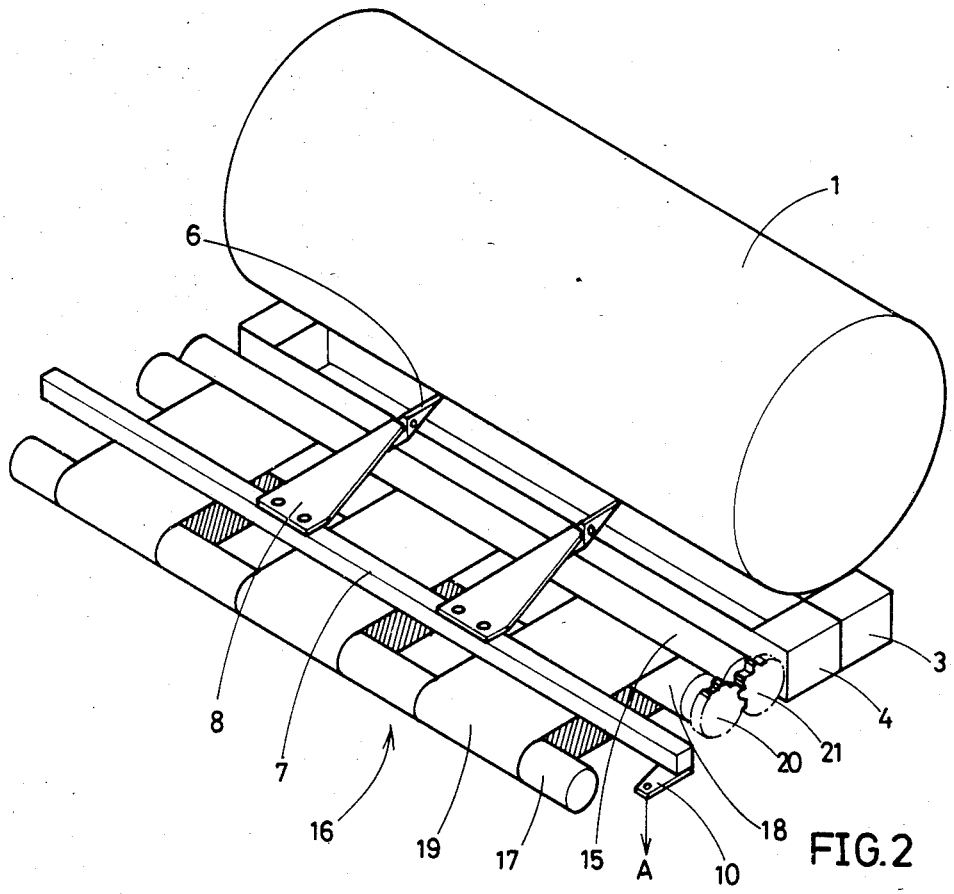
FIG. 2 is a perspective view of the cleaning device of FIG. 1.

FIG. 1 is a side view of a cleaning device for cleaning a separation device such as a separation claw in an electrophotographic copying machine according to the present invention. FIG. 2 is a perspective view of this cleaning device.

Referring now to FIGS. 1 and 2, the copying machine comprises a photoreceptor 1 disposed around a rotational drum. The photoreceptor 1 includes a photoconductive layer on the outermost surface thereof. Although not specifically shown in FIG. 1, a discharger may be provided for charging the photoreceptor 1, a light exposing device may be provided for exposing light toward a document mounted on a document table as the document table is reciprocated in accordance with the rotation of the drum and the photoreceptor 1, so that the reflected light beams from the document are incident upon the photoreceptor 1 through an optical system to form an electrostatic latent image thereon. A developing device may be provided for developing the latent image with toner particles to form a toner image. A transference discharger 3 is provided for transferring the toner image onto a copy paper 2 picked up from a number of copy papers within a cassette by applying a corona charge having the same polarity as the voltage of the latent image on the photoreceptor 1 and an opposed polarity to the charges of the toner particles attached onto the photoreceptor 1.

In parallel with the transfer corona discharger 3, an AC corona discharger 4 is provided for developing an AC corona after the corona transfer and behind the copied paper 2 to weaken the attraction of the copied paper 2 to the photoreceptor 1. A plurality of paper pick-up rollers may be provided for picking up a single copy paper 2 from the papers within the cassette. A plurality of paper feeding rollers may be provided for feeding the picked-up copy paper 2 into the transference charger. A charge removing charger may be provided for charging the photoreceptor 1 in a polarity opposed to the polarity of the remaining charges on the photoreceptor 1 to remove the charges from the photoreceptor 1. A lighting device may be provided for lighting the photoreceptor 1 to remove the charges from the photoreceptor 1. A pair of fixing rollers may be provided for pressing the toner image onto the copy paper 2 to fix the toner image thereon. A pair of exhaust rollers may be provided for expelling the copied paper from the body of the copying machine to place it onto an expel tray.

It is to be noted that the application of the present invention should not be limited to the copying machine of the type as described above.

Figure 3:
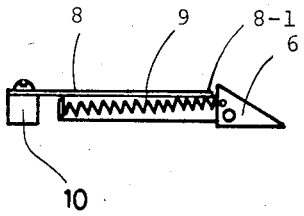
FIG. 3 is a side view of the separation claw.
Figure 4:
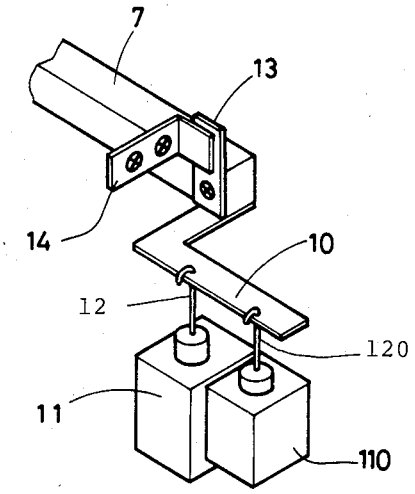
FIG. 4 is a perspective view of a rotation assembly for rotating the separation claw of FIG. 3.

According to the present invention, a separation claw 6 is positioned so as to confront the surface of the photoreceptor 1 at the rear of the AC corona discharger 4. The separation claw 6 is attached to a supporting plate 8 fixed to a rotatable shaft 7. The tip of the separation claw 6 is close to or in contact with the photoreceptor 1. As shown in FIG. 3, a spring 9 extends between the separation claw 6 and the supporting plate 8. Since the separation claw 6 is pivotally mounted on the tip of the supporting plate 8 and the spring 9 is thus arranged, the separation claw 6 is rotatably forced counterclockwise in the drawing. The rotative force of the separation claw 6 is restricted because the separation claw 6 rests against an end 8-1 of the supporting plate 8. The separation claw 6 becomes in contact with the photoreceptor 1 at a pressure of about 3 g with help of the force of the spring 9.

At one end of the rotatable shaft 7, a lever 10 is fixed and an absorption means such as solenoids 11 and 110 is coupled by connection bars 12 and 120. When the solenoids 11 and 110 are energized, the connection bars 12 and 120 are attracted and the lever 10 is pulled down in a direction A, so that the separation claw 6 becomes close to the surface of the photoreceptor 1 around the shaft 7. On the contrary, when the solenoids 11 and 110 are not energized, the separation claw 6 becomes far from the surface of the photoreceptor 1 on account of the weight of the claw 6 or the energization of the spring 9, so that the tip of the claw 6 is pivotally moved below the transport way B of the copied paper 2. That is, the claw 6 is pivotally moved between the separation position of separating the copied paper 2 from the photoreceptor 1 as shown in the true line of FIG. 1 and the cleaning position of cleaning at least the tip of the claw 6 as shown in the dotted line of FIG. 1.

When the solenoid 11 is energized, the rotation means such as the supporting plate 8 allows the claw 6 to tend to become upright rather than allowing the claw to face against the surface of the photoreceptor 1. Some possible loosed-joint at the connection bar 12 interposed between the solenoid 11 and the rotation means allows the upright shift of the claw 6 in which the claw 6 overloads the photoreceptor 1. The loosed-joint at the connection bar 12 is needed to smoothly move the solenoid 11 and the lever 10. To severely restrict the pivotal movement of the claw 6, a rotational regulation means is provided for absorbing a degree of the loosed-joint at the connection bar 12 rather than any stroke amendment of the solenoid 11. This rotational regulation means is a stopper 13 and a rotation regulation plate 14. The stopper 13 is fixed to the shaft 7 while the rotation regulation plate 14 is fixed to the body of the copying machine. They are positioned so that, when the stopper 13 confronts the rotation regulation plate 14, the tip of the claw 6 is slightly in contact with the surface of the photoreceptor 1.

When the solenoids 11 and 110 are not energized, the claw 6 is pivotally positioned at the cleaning position which is symmetrical with the separation position. At this cleaning position, a cleaning means 15 is provided for coming into contact with at least the tip of the claw 6 to disturb any further pivotal rotation of it and clean it. The cleaning means 15 comprises a soft hair such as a fur brush. The cleaning device means 15 is rotated because the rotation of the transport device 16 is fed into the cleaning means 15. The transport device 16 is provided for transporting the separated copied paper 2 toward the fixing device.

The transport device 16 includes a driving roller 17, a follower roller 18, and a transport belt 19 entrapped between the driving roller 17 and the follower roller 18. A first gear 20 is fixed to an end of the shaft of the follower roller 18. A second gear 21 is connected to an end of the shaft of the cleaning means 15. The cleaning means 15 is rotated in unison with the operation of the transport device 16. It may be limitative that the cleaning means 15 is rotated in conjunction with the operation of the transport device 16. It may be possible that the cleaning means 15 is rotated with any additional driving device.

The solenoid 11 is energized to allow the claw 6 to rest against the surface of the photoreceptor 1 regardless of the operation of the solenoid 110. The solenoid 110 is not energized to allow the claw 6 to become far from the photoreceptor surface (about 1 mm), so as not to scrape the remaining toner particles.

A first paper detection element S1 is provided for detecting whether the copy paper 2 is about to be introduced into the transference discharger 3. In response to the detection of the element S1, the solenoids 11 and 110 are energized. Here, before the copy paper 2 is separated, the claw 6 is ready at the separation position. After the solenoids 11 and 110 are energized, a timer is started to count a preset time. After the preset time, the solenoid 11 is unenergized (OFF), so that the solenoid 110 is left energized (ON). By this control, after the separation of the copy paper 2, the claw 6 becomes far from the surface of the photoreceptor 1, for example, by about 1 mm. The preset time counted by the timer is the time when the copy paper 2 is separated by the claw 6 posterior to the corona transfer and layered on the transport device 16. Immediately after the claw 6 has started to separate the copy paper 2 from the photoreceptor 1, the position of the claw 6 is moved from the separation position so that the claw 6 does not scrape the remaining toner particles from the photoreceptor 1. A second paper detection element S2 is provided for detecting whether the copy paper 2 is about to be transported by the transport device 16 by detecting the rear edge of the copy paper 2. In response to the detection of the second paper detection element S2, the solenoids 11 and 110 are not energized until the next paper is detected by the first paper detection element S1. Thus, the solenoids 11 and 110 are energized.

With the above-described arrangement, the toner image formed on the photoreceptor 1 is electrostatically transferred into the copy paper 2 by the transfer corona discharger 3. At this time, before the copy paper 2 faces the transfer corona discharger 3, the end of the copy paper 2 is detected by the first paper detection element S1. Then, the solenoids 11 and 110 are energized to make the claw 6 positioned at the separation position in front of the photoreceptor 1 as described above.

Figure 6:
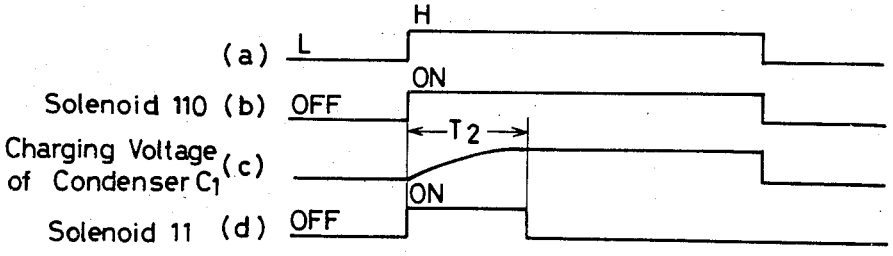
FIG. 6 is a time chart of signals occurring within the circuit of FIG. 5.

FIG. 6 is a configuration of a circuit for driving the solenoids 11 and 110. A signal (a) is developed by the first paper detection element S1 when it detects the paper. This signal (a) is applied to a base of a transistor Q1 through a resistance R1. A power source of "+V" volts is connected to a collector of the transistor Q1 through the solenoid 110. An emitter of the transistor Q1 is grounded. In response to the application of the signal (a), the transistor Q1 becomes conductive and the solenoid 110 is energized. An emitter of a transistor Q4 is coupled to the collector of the transistor Q1. The transistor Q4 is provided for switching the solenoid 11. The solenoid 11 is connected between the collector of the transistor Q4 and the power source of "+V". The "+V" power source is connected to a base of the transistor Q4 through a resistance R4 and a Zener diode ZD3. The base of the transistor Q4 is coupled to the collector of the transistor Q1 through a resistance R6. Then, the conductivity of the transistor Q1 enables the conductivity of the transistor Q4, immediately, so that the solenoid 11 is energized at the same time when the solenoid 110 is energized. Therefore, the claw 6 is positioned in front of the surface of the photoreceptor 1 for paper separation on account of the pivotal movement means. FIG. 6 is a time chart at this stage.

After the copy paper 2 has passed the transfer corona discharger 3 and when it is now under the operation of the AC corona discharger 4, the AC corona discharger 4 is activated for weakening the attraction of the copied paper 2 close to the photoreceptor 1. Thus, the copied paper 2 may be automatically separated from the photoreceptor 1 owing to the tightness and the weight of the paper per se. Otherwise, the copied paper 2 may be left close to the photoreceptor 1 and be transported to the separation position at which the claw 6 is operated to separate the copy paper 2. The claw 6 forcibly separates the copied paper 2 from the photoreceptor 1. Owing to the weight of the paper 2, the separation is carried out, so that it is transported by the transport device 16.

Here, a time T1 is constant during which the first paper detection element S1 detects the paper 2 and the paper 2 reaches to the separation position adjacent the claw 6. The solenoid 11 is unenergized at a time T2 equivalent to the time T1 plus a possible error time. That is, at the time T2 after the element S1 detects the paper 2, the paper 2 is started to be separated by the separation claw 6 unless any paper jam occurs. Therefore, after the time T2, the solenoid 11 is unenergized so that the claw 6 is far from the photoreceptor 1 by, for example, about 1 mm.

Figure 5:
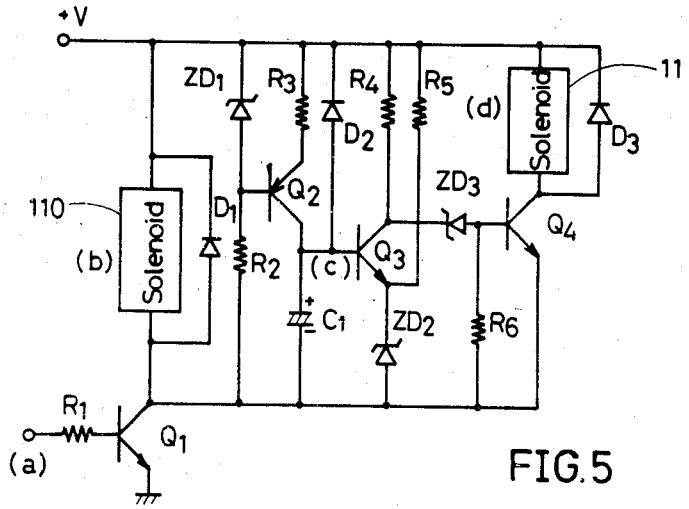
FIG. 5 is a configuration of a circuit for rotating the separation claw of FIG. 3.

The energization of the solenoid 11 will be described in detail with reference to the driving circuit of FIG. 5. A Zener diode ZD1 and a resistance R2 are connected between the "+V" power source and the collector of the transistor Q1. A base of the transistor Q2 is connected to the connection point between the Zener diode ZD1 and the resistance R2. A resistance R3 is connected between the emitter of the transistor Q2 and the "+V" power source. A condenser C1 is connected to a collector of the transistor Q2 and the collector of the transistor Q1. The resistance R3 and the condenser C1 form a timer circuit. A charge voltage (c) of the condenser C1 is applied to the base of the transistor Q3. The emitter of the transistor Q3 is connected to the collector of the transistor Q1 through the Zener diode ZD2. The collector of the transistor Q3 is coupled to the connection point between the resistance R4 and the Zener diode ZD3. The "+V" power source is connected to the connection point between the emitter of the transistor Q3 and the Zener diode ZD2 through a resistance R5.

With this circuit arrangement, after the element S1 detects the front edge of the paper 2, the transistor Q2 turns on immediately with the ON condition of the transistor Q1, so that the condenser C1 is charged through the resistance R3. When the charge voltage (c) of the condenser C1 is greater than the voltage of the Zener diode ZD2 plus a base-emitter voltage $V_{BE}$ of the transistor Q3, the transistor Q3 turns on. Therefore, the transistor Q4 is turned off, so that the solenoid 11 is unenergized while the solenoid 110 is left energized. The unenergization of the solenoid 11 permits the solenoid 110 to continue to make the claw 6 far from the photoreceptor 1 by, for example, about 1 mm. The solenoid 11 is unergized after the time T2 when the paper 2 has passed the separation position. For this purpose, the values of the resistance R3 and the condenser C1 forming the timer circuit are selected so that, after the time T2, the charge voltage of the condenser C1 is greater than the voltage of the Zener diode Zd2 plus the base-emitter voltage $V_{BE}$ of the transistor Q3. Therefore, immediately after the claw 6 has started to separate the paper 2 from the photoreceptor 1, the claw 6 becomes far from the photoreceptor 1 and this positioning is maintained by the solenoid 110.

The thus separated paper is transported by the transport device 16. When the second paper detection element S2 detects the rear edge of the paper, the element being positioned at the rear of the separation position, the solenoid 110 is unenergized. The element S2 provides a signal (a) on a low level "L" representing that it detects the rear edge of the paper. The "L" signal (a) is applied to the transistor Q1, so that it turns off. Therefore, the solenoid 110 is unenergized. When the solenoid 11 is left unenergized, the pivotal force of the claw 6 toward the photoreceptor 1 cannot be caused, so that the claw 6 is pivotally moved around the shaft 7 owing to the weight of itself. Eventually, the claw 6 is positioned at the cleaning position by the cleaning device 15 below the paper transport way B. The claw 6 is cleaned by the cleaning device 15 to thereby remove the toner dust.

When the next copy paper 2 is introduced into the transference region, the solenoids 11 and 110 are turned ON in response to the detection, so that the claw 6 is pivotally moved upright around the shaft 7 toward the separation position so as to be in front of the photoreceptor 1. Thus, the claw 6 is cleaned by the cleaning means 15 per copy operation, so that it is continuously clean and free of toner particles. The copied paper 2 cannot be dusted by the toner particles. Since the claw 6 is cleaned below the transport way B, the removed toner particles can be prevented from dropping on the copy paper 2. The claw 6 is far from the photoreceptor 1 after the separation of the copied paper 2, it cannot scrape the remaining toner particles on the photoreceptor 1. It is impossible for the toner particles scraped from the photoreceptor 1 to dust the copy paper 2.

In the above description, the cleaning device 15 is described as the rotating fur brush. However, the cleaning device of the present invention should not be limited to such a means. Further, it may be evident that the AC corona discharger 4 can be removed, so that the separation claw 6 solely separates the copied paper 2.

While only certain embodiments of the present invention have been described, it will be apparent to those skilled in the art that various changes and modifications may be made therein without departing from the spirit and scope of the present invention as claimed.

What is claimed is:

1. A cleaning device in an electrophotographic copying machine for cleaning a separation claw which separates a copy paper from a photoreceptor, comprising:

detection means for detecting an approach of said copy paper toward said photoreceptor and for detecting separation of said copy paper from said photoreceptor;

movement means responsive to said detection means, for pivotally moving said separation claw between a first position wherein said separation claw means becomes close to said photoreceptor to separate said copy paper from said photoreceptor, and a second position wherein said separation claw is far from said photoreceptor; and cleaning means for cleaning at least a tip of said separation claw which is close to said copy paper while said separation claw is positioned at the second position.

2. The device of claim 1, wherein said movement means comprises a pair of solenoids for pivotally moving said separation claw.

3. The device of claim 1, wherein a first solenoid is provided which is turned on to move said separation claw close to said photoreceptor and a second solenoid is provided which is turned off to move said separation claw far from said photoreceptor.

4. The device of claim 1, further comprising a timer circuit means for counting a time when said copy paper is initially separated by said separation claw and said copy paper is layered on a paper transport device for transporting said copy paper toward a subsequent portion of said copying machine.

5. The device of claim 4, wherein said timer circuit means includes a resistance and a condenser.

* * * * *